US006568141B2

(12) United States Patent
Kremers

(10) Patent No.: US 6,568,141 B2
(45) Date of Patent: May 27, 2003

(54) CONCRETE FOOTING AND WALL SYSTEM

(76) Inventor: Dennis H. Kremers, 21952 - 88th Ave., St. Cloud, MN (US) 56301

( * ) Notice: Subject to any disclaimer, the term of this patent is extended or adjusted under 35 U.S.C. 154(b) by 0 days.

(21) Appl. No.: 09/912,567

(22) Filed: Jul. 24, 2001

(65) Prior Publication Data

US 2003/0019175 A1 Jan. 30, 2003

(51) Int. Cl.[7] ..... E04B 2/40

(52) U.S. Cl. ..... 52/426; 52/293.1; 52/428; 52/742.14; 249/33; 249/34

(58) Field of Search ..... 52/294, 293.1, 52/426, 428, 742.14, 745.09, 127.2, 127.3, 565; 249/33, 34

(56) References Cited

U.S. PATENT DOCUMENTS

| | | | | |
|---|---|---|---|---|
| 3,195,852 | A | | 7/1965 | Lundell |
| 3,855,751 | A | * | 12/1974 | Struthers |
| 4,600,459 | A | * | 7/1986 | Proctor |
| 5,224,321 | A | * | 7/1993 | Fearn |
| 5,495,696 | A | * | 3/1996 | Repka |
| 5,511,761 | A | | 4/1996 | Schultz |
| 5,794,393 | A | * | 8/1998 | Fearn |
| 5,882,540 | A | | 3/1999 | Farrington |
| 5,922,236 | A | | 7/1999 | Zuhl |
| 6,016,633 | A | | 1/2000 | Elwart |
| 6,158,710 | A | | 12/2000 | Matthews |
| 6,343,894 | B1 | * | 2/2002 | Fearn |
| 6,397,536 | B1 | * | 6/2002 | Morello |

FOREIGN PATENT DOCUMENTS

| | | | |
|---|---|---|---|
| JP | 330119 | * | 4/1992 |

* cited by examiner

*Primary Examiner*—Blair M. Johnson
(74) *Attorney, Agent, or Firm*—Michael S. Neustel

(57) ABSTRACT

A concrete footing and wall system for increasing the efficiency in forming concrete foundations for building structures. The concrete footing and wall system includes a first preformed wall, a second preformed wall connected to the first preformed wall, and a lower reservoir formed within the lower portions of the walls for receiving a volume of concrete. The walls are distally spaced apart and receive a volume of concrete along with the reservoir being filled. The reservoir is preferably comprised of a flexible material such as plastic or textile. The walls are supported a finite distance in a level manner above a ground surface by the usage of a plurality of support members. The reservoir has a pair of end openings which allows the concrete to merge and bond with adjacent walls and reservoirs.

15 Claims, 11 Drawing Sheets

CONCRETE FOOTING AND WALL SYSTEM

BACKGROUND OF THE INVENTION

1. Field of the Invention

The present invention relates generally to concrete foundation systems and more specifically it relates to a concrete footing and wall system for increasing the efficiency in forming concrete foundations for building structures.

2. Description of the Prior Art

Concrete forms and similar structures have been in use for years. When creating a concrete foundation, the footings are first poured to provide a solid base to construct the concrete walls upon. After the footings have hardened, forms are positioned about the footings extending upwardly forming a hollow space between which is filled with concrete and allowed to harden with the forms removed thereby forming the concrete wall for a basement or similar structure.

The main problem with conventional concrete foundation systems is that they require a significant amount of labor to construct. In additional conventional concrete foundation systems require a plurality of forms that are expensive to purchase and maintain. Further, conventional concrete foundation systems require the footings to be formed and hardened prior to forming the wall portion of a concrete foundation thereby requiring a significant amount of time to construct and requiring a crew of workers to return to the work site twice to perform work.

Examples of patented concrete systems include U.S. Pat. No. 5,882,540 to Farrington; U.S. Pat. No. 5,511,761 to Schultz; U.S. Pat. No. 5,922,236 to Zuhl; U.S. Pat. No. 6,016,633 to Elwart; U.S. Pat. No. 6,158,710 to Matthews; U.S. Pat. No. 3,195,852 to Lundell.

While these devices may be suitable for the particular purpose to which they address, they are not as suitable for increasing the efficiency in forming concrete foundations for building structures. Conventional concrete foundation systems are expensive to utilize and inefficient when forming a concrete foundation.

In these respects, the concrete footing and wall system according to the present invention substantially departs from the conventional concepts and designs of the prior art, and in so doing provides an apparatus primarily developed for the purpose of increasing the efficiency in forming concrete foundations for building structures.

SUMMARY OF THE INVENTION

In view of the foregoing disadvantages inherent in the known types of concrete foundation systems now present in the prior art, the present invention provides a new concrete footing and wall system construction wherein the same can be utilized for increasing the efficiency in forming concrete foundations for building structures.

The general purpose of the present invention, which will be described subsequently in greater detail, is to provide a new concrete footing and wall system that has many of the advantages of the concrete foundation systems mentioned heretofore and many novel features that result in a new concrete footing and wall system which is not anticipated, rendered obvious, suggested, or even implied by any of the prior art concrete foundation systems, either alone or in any combination thereof.

To attain this, the present invention generally comprises a first preformed wall, a second preformed wall connected to the first preformed wall, and a lower reservoir formed within the lower portions of the walls for receiving a volume of concrete. The walls are distally spaced apart and receive a volume of concrete along with the reservoir being filled. The reservoir is preferably comprised of a flexible material such as plastic or textile. The walls are supported a finite distance in a level manner above a ground surface by the usage of a plurality of support members. The reservoir has a pair of end openings which allows the concrete to merge and bond with adjacent walls and reservoirs.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a concrete footing and wall system that will overcome the shortcomings of the prior art devices.

A second object is to provide a concrete footing and wall system for increasing the efficiency in forming concrete foundations for building structures.

Another object is to provide a concrete footing and wall system that eliminates forming concrete footings and walls separately.

An additional object is to provide a concrete footing and wall system that reduces the amount of time and labor required to construct a concrete foundation.

A further object is to provide a concrete footing and wall system that does not require the usage of concrete forms.

Another object is to provide a concrete footing and wall system that conforms easily to irregular terrain and creates footings that are formed to the contours of the ground surface.

A further object is to provide a concrete footing and wall system that requires less training for employees.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
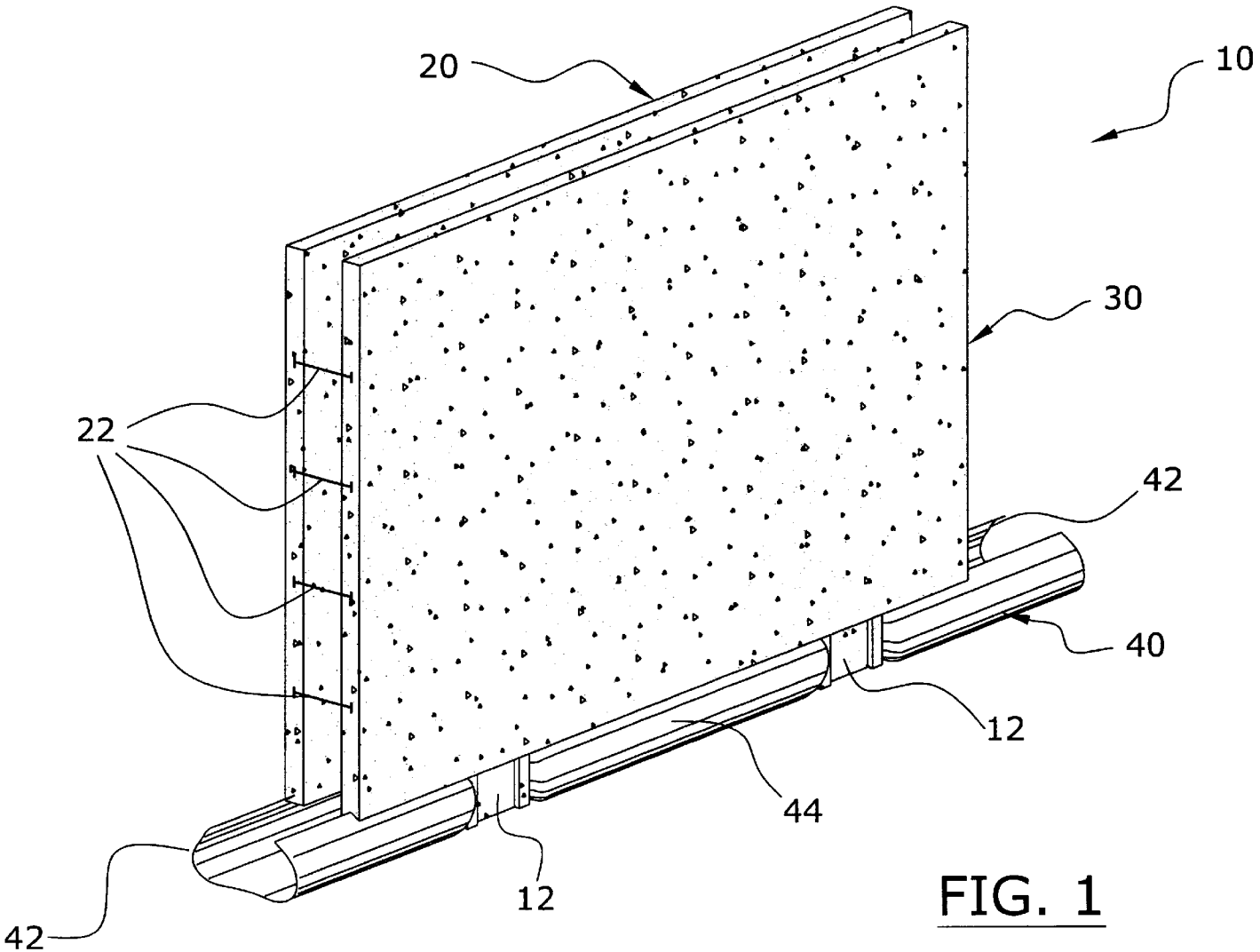
FIG. 1 is an upper perspective view of the present invention.

Turning now descriptively to the drawings, in which similar reference characters denote similar elements throughout the several views, FIGS. 1 through 11 illustrate a concrete footing and wall system 10, which comprises a first preformed wall 20, a second preformed wall 30 connected to the first preformed wall 20, and a lower reservoir 40 formed within the lower portions of the walls 20, 30 for receiving a volume of concrete 18. The walls 20, 30 are distally spaced apart and receive a volume of concrete 18 along with the reservoir 40 being filled. The reservoir 40 is preferably comprised of a flexible material such as plastic or textile. The walls 20, 30 are supported a finite distance in a level manner above a ground surface 14 by the usage of a plurality of support members 12. The reservoir 40 has a pair of end openings 42 which allows the concrete 18 to merge and bond with adjacent walls 20, 30 and reservoirs 40.

As shown in FIGS. 1, 2, 5 and 7 of the drawings, a first preformed wall 20 and a second preformed wall 30 are connected substantially parallel to one another. The walls 20, 30 are preformed off the work site within a conventional manufacturing facility utilizing conventional building materials and methods. The walls 20, 30 are preferably comprised of reinforced concrete 18, however various other materials may be utilized to construct the walls 20, 30 as can be appreciated. The walls 20, 30 may have various shapes and sizes, however the dimensions of the walls 20, 30 are preferably substantially similar to one another.

Figure 7:
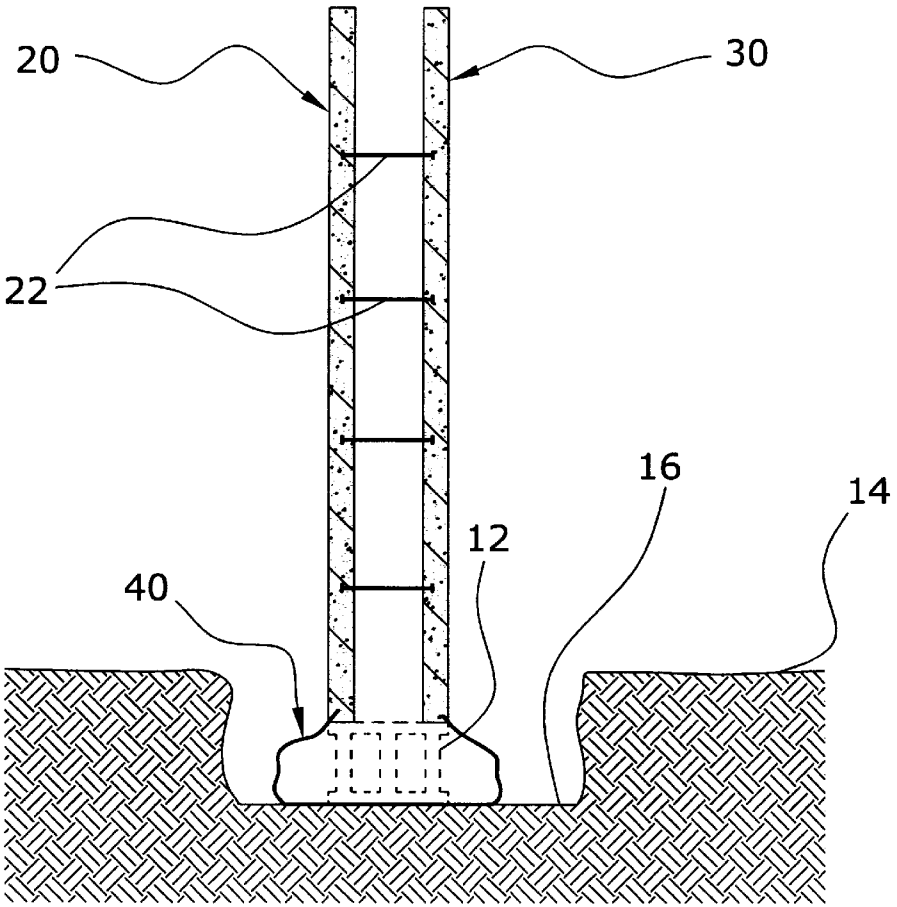
FIG. 7 is an end view of the present invention.

As best shown in FIG. 7 of the drawings, the walls 20, 30 are connected to one another utilizing a plurality of cross members 22. The cross members 22 are preferably formed within the walls 20, 30 during the manufacture thereof, however the cross members 22 may be added between the walls 20, 30 after the walls 20, 30 have been formed utilizing conventional fastening and securing methods.

Figure 2:
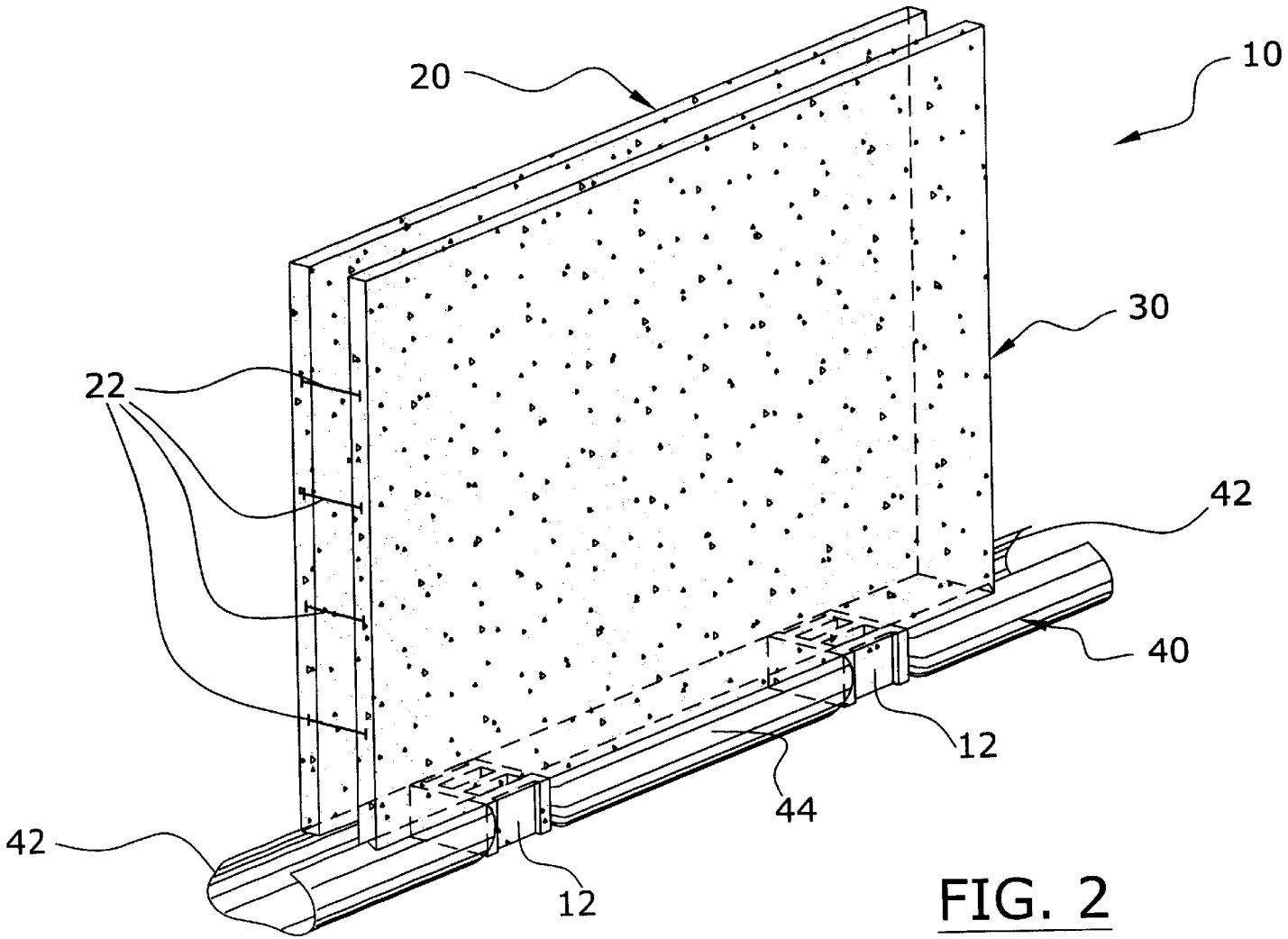
FIG. 2 is an upper perspective view of the present invention with shadow lines.
Figure 3:
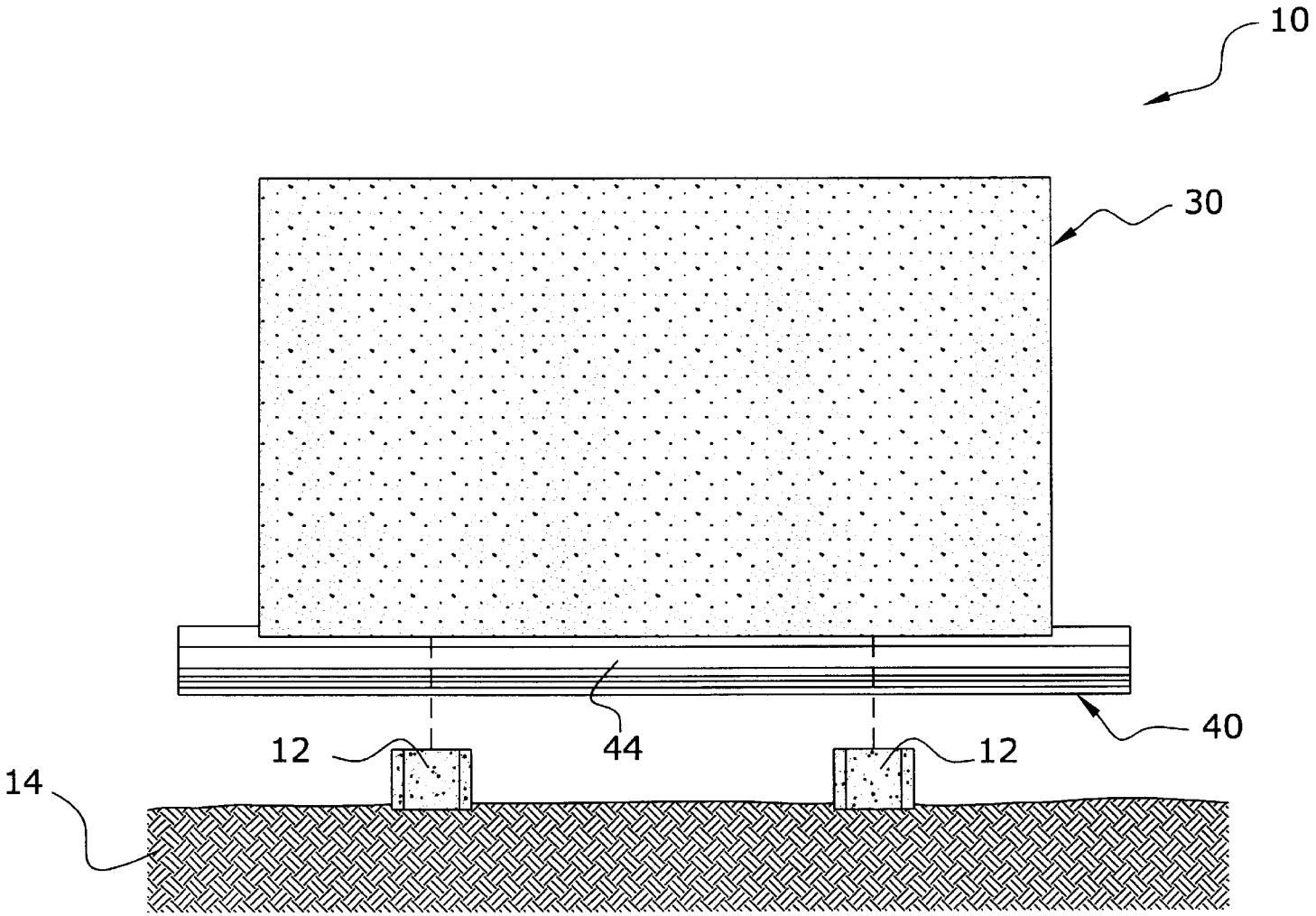
FIG. 3 is an exploded side view of the present invention positioned above a work site with concrete blocks positioned within the footing trench.
Figure 4:
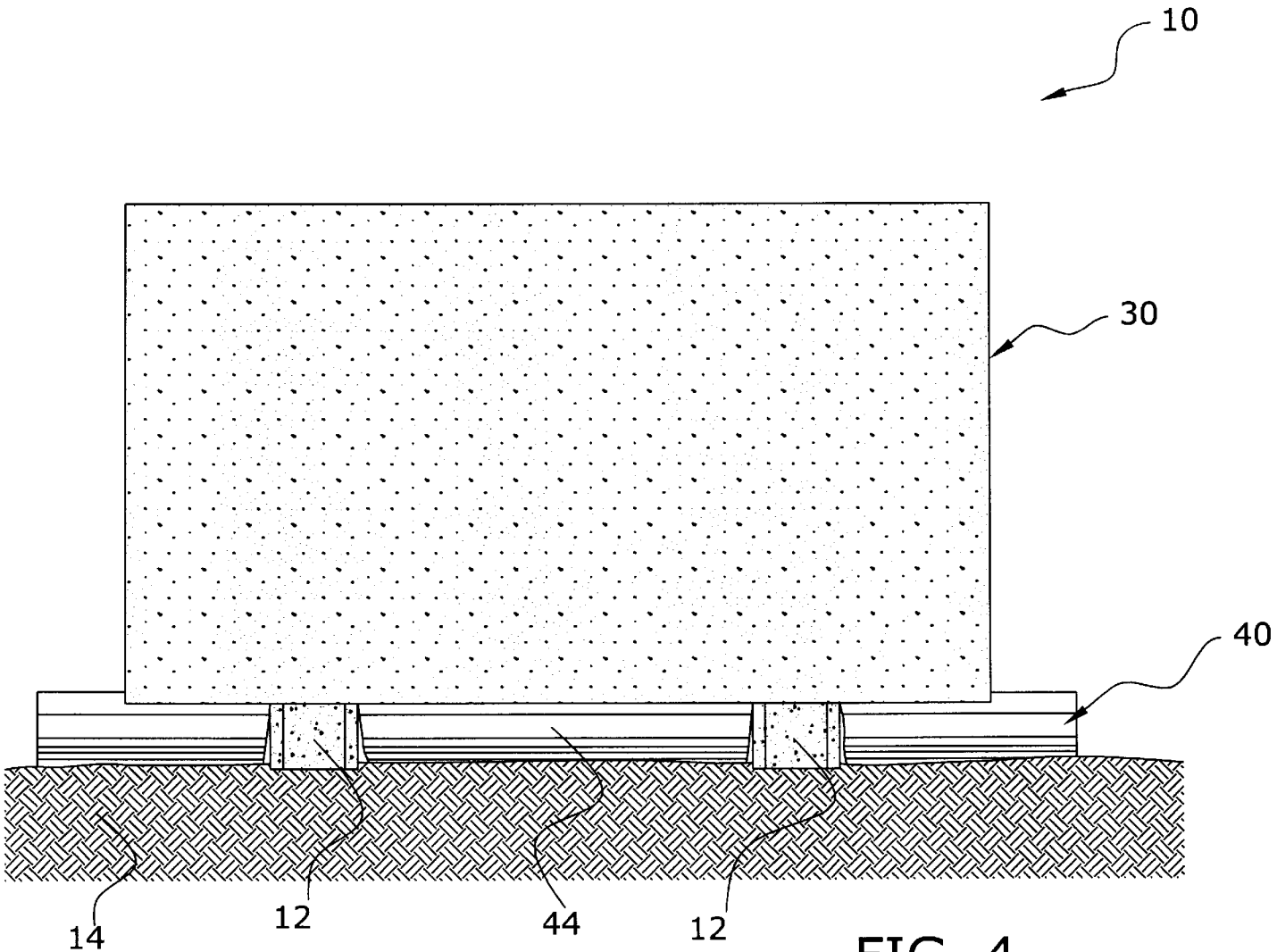
FIG. 4 is a side view of the present invention positioned upon the concrete blocks.
Figure 8:
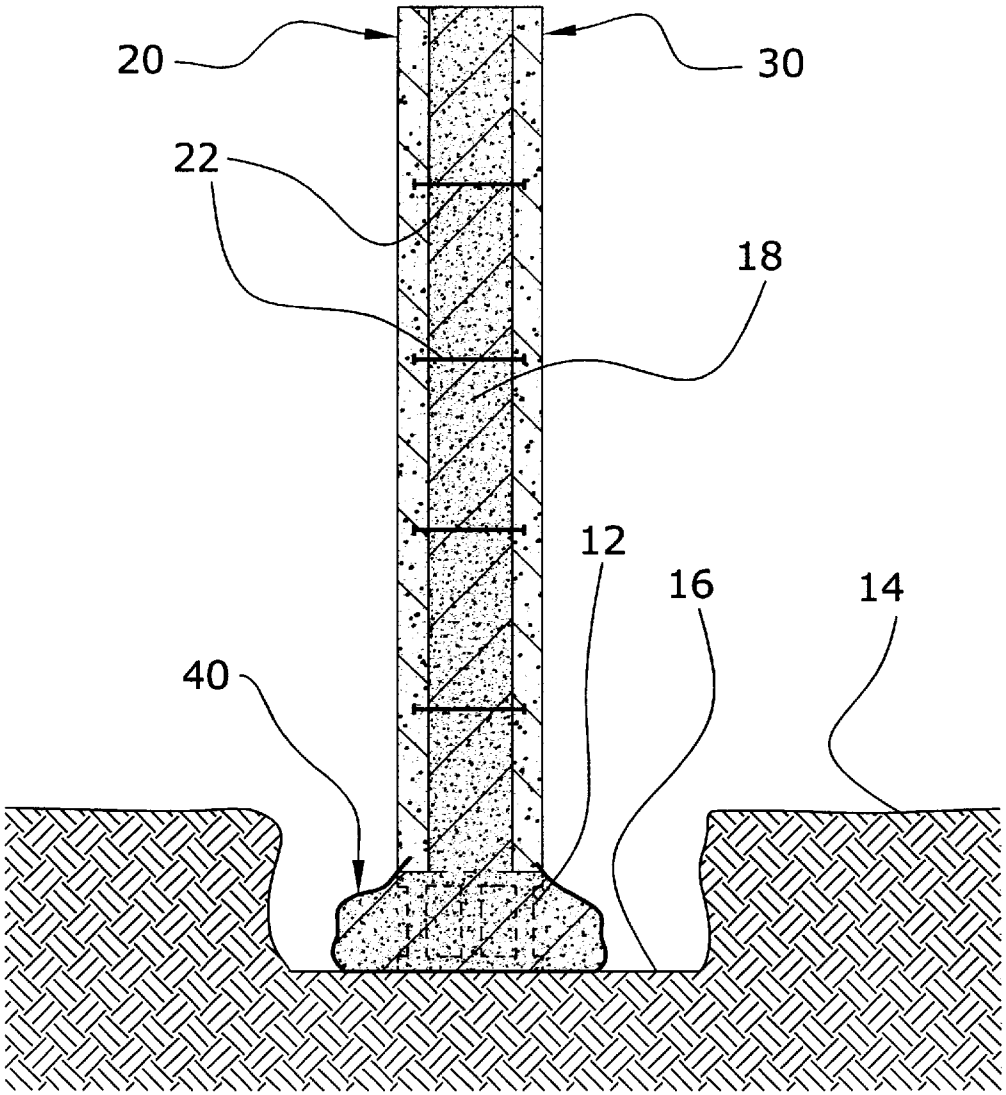
FIG. 8 is an end view of the present invention filled with concrete or similar material.

As shown in FIGS. 1 through 4 of the drawings, a reservoir 40 is attached to the lower portions of the walls 20, 30 forming a receiving portion that receives a volume of concrete 18 that forms the footing portion. The reservoir 40 is comprised of a flexible material such as but not limited to plastic or textile materials for allowing conforming to the surface of the footing trench 16. The reservoir 40 preferably extends along and past the entire length of the walls 20, 30 as best illustrated in FIG. 3 of the drawings. The reservoir 40 forms an elongate channel and floor between the walls 20, 30 that expands outwardly when filled with concrete 18 as shown in FIG. 8 of the drawings. The distal ends of the reservoir 40 are preferably preformed within the walls 20, 30 during the manufacturing of the walls, however the reservoir 40 may be attached to the lower portions of the walls 20, 30 off or on site.

Figure 5:
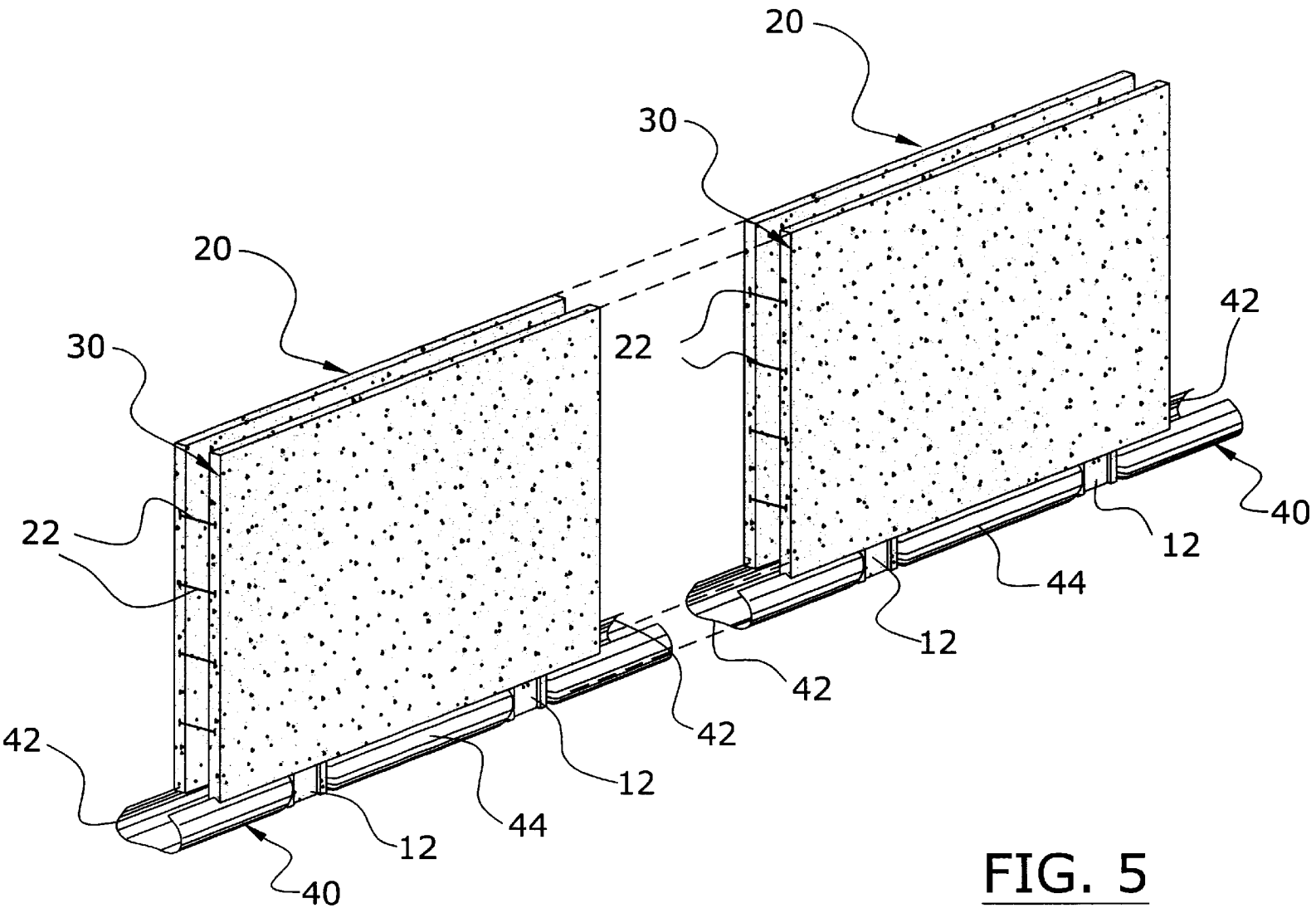
FIG. 5 is an exploded upper perspective view illustrating a pair of the present invention adjacent to one another.
Figure 6:
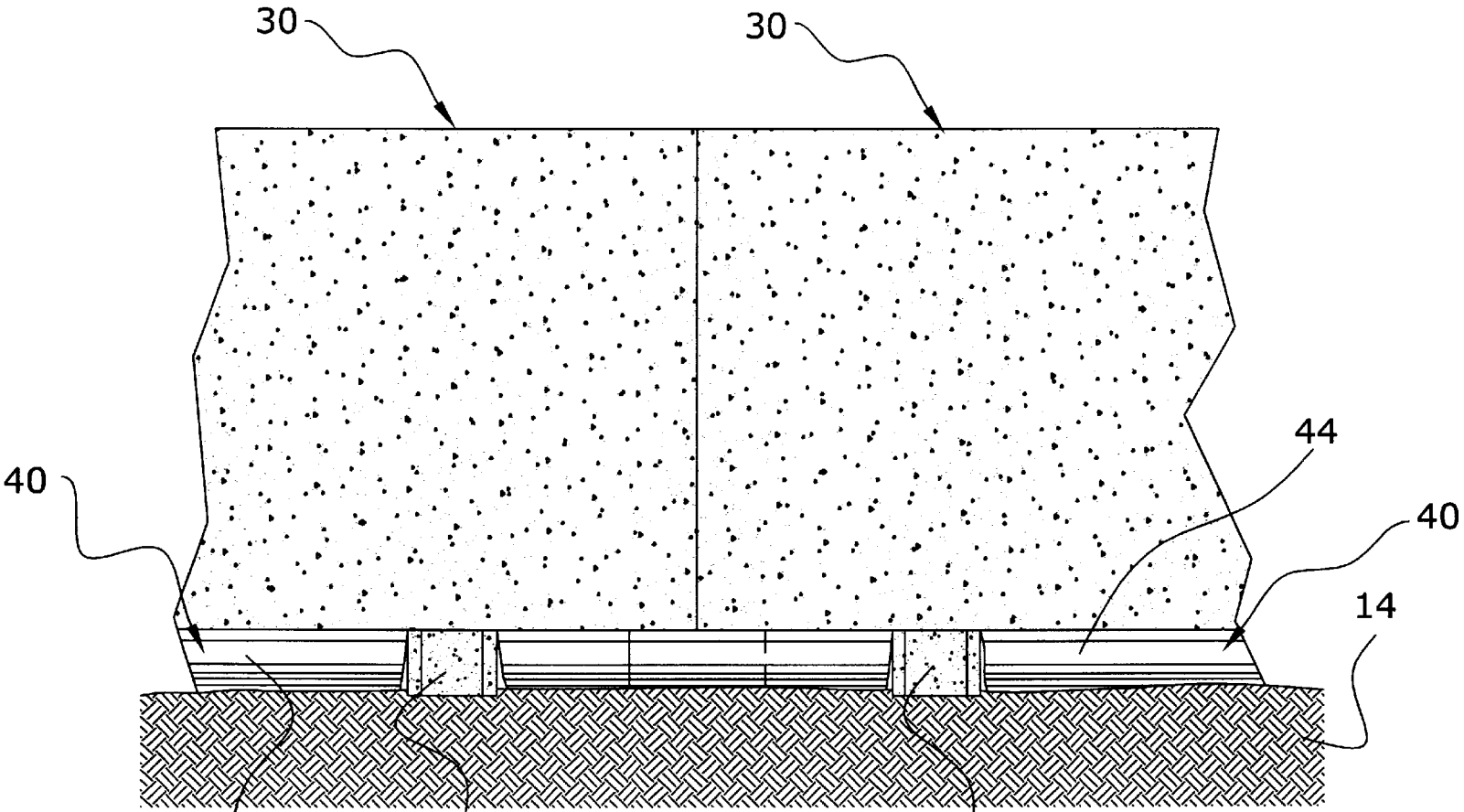
FIG. 6 is a side view illustrating the pair of the present invention positioned adjacent one another forming a wall structure.

As shown in FIGS. 1, 2 and 5 of the drawings, the reservoir 40 includes a pair of opposing end openings 42 and a solid middle portion 44. The end openings 42 allow the liquid concrete 18 to flow outwardly from thereof for merging and bonding with adjacent reservoirs 40 and walls 20, 30 thereby forming a solid continuous foundation.

The walls 20, 30 must be supported a finite distance above the floor of the footing trench 16 as best shown in FIGS. 7 through 10 of the drawings. One method of supporting the walls 20, 30 is to insert a plurality of support members 12 beneath the walls and the reservoir 40 as shown in FIGS. 1 through 8 of the drawings. The support members 12 may be comprised of conventional blocks or similar support devices. The reservoir 40 is simply elevated upwardly in the portions supported by the support members 12. When the concrete 18 is poured within the walls 20, 30 and the reservoir 40, the support members 12 are simply left within for additional support thereof.

Figure 9:
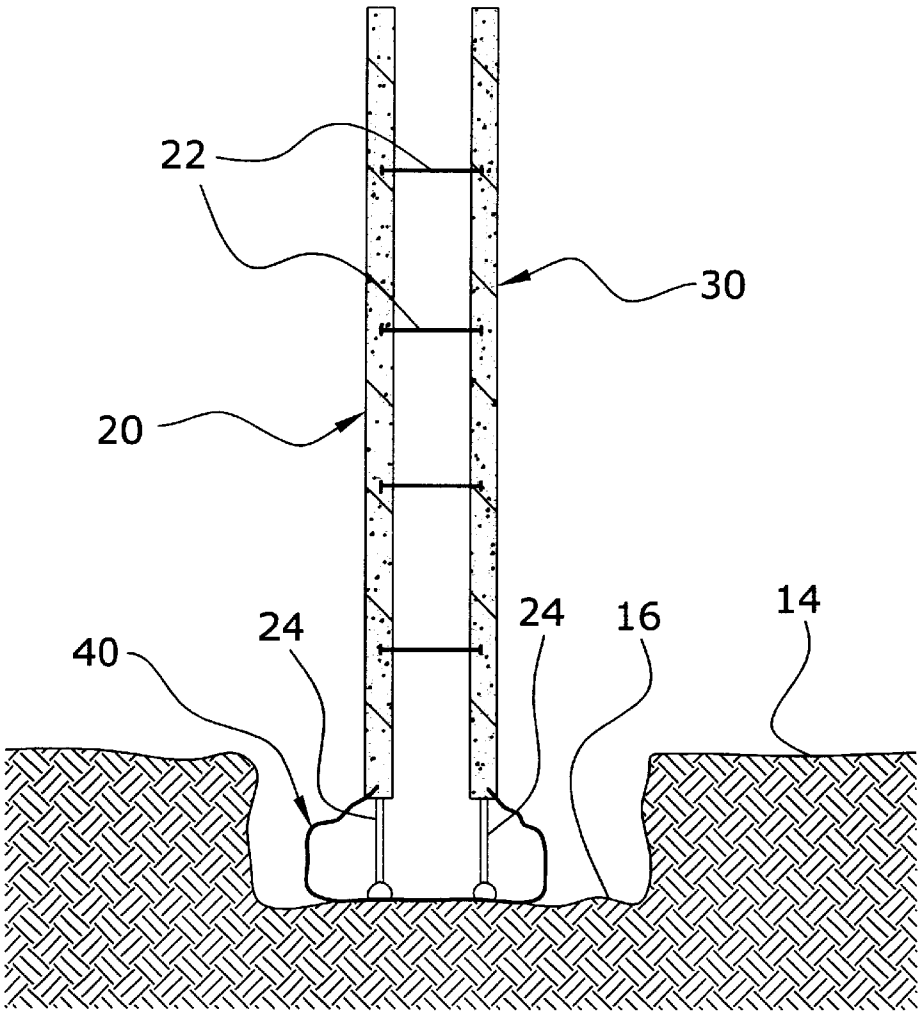
FIG. 9 is an end view of an alternative embodiment of the present invention utilizing support poles to support the side walls.

A second method for supporting the walls 20, 30 includes utilizing support poles 24 within the lower ends of the walls 20, 30 to support the walls 20, 30 a finite distance above the floor of the footing trench 16 and relative to the surrounding ground surface 14 as shown in FIG. 9 of the drawings. The support poles 24 may be formed or secured to the walls 20, 30 as can be appreciated. The lower ends of the support poles 24 are preferably rounded to prevent damage to the reservoir 40 during installation.

Figure 10:
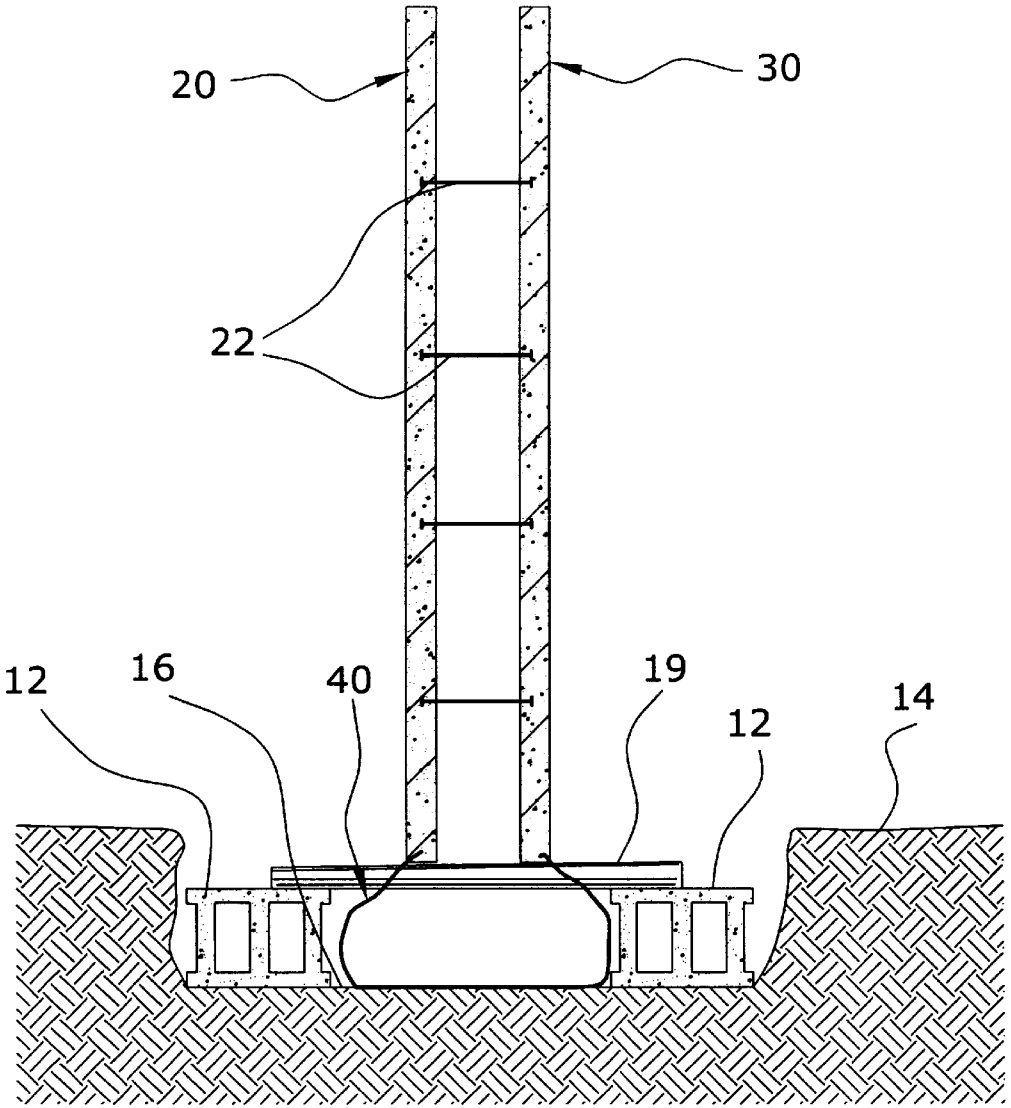
FIG. 10 is an end view of a second alternative embodiment of the present invention utilizing a tapered shaft to support the side walls.
Figure 11:
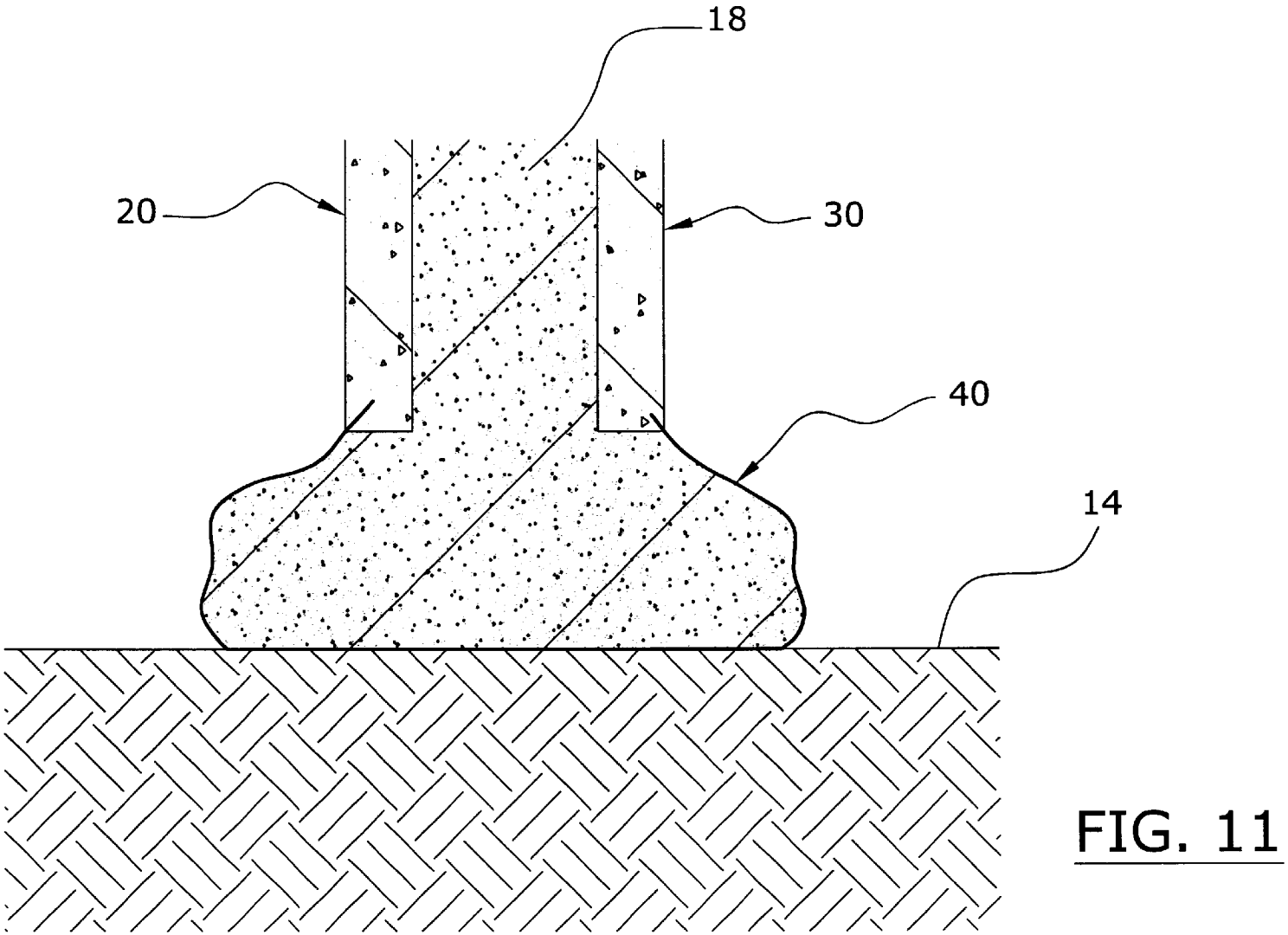
FIG. 11 is a magnified cross sectional view of the side walls and the lower reservoir filled with concrete.

A third method for supporting the walls 20, 30 includes utilizing a pair of support members 12 positioned on adjacent sides of the walls 20, 30 with a tapered shaft 19 extended underneath the walls 20, 30 and the reservoir 40 as shown in FIG. 10 of the drawings. After the concrete 18 has hardened, the tapered shaft 19 is driven out from underneath the walls 20, 30 and the reservoir 40 and the support members 12 are removed for later usage.

In use, the user digs a footing trench 16 as they typically would create for a conventional footing. The user then places a plurality of support members 12 within the footing trench 16 as desired to support the walls 20, 30 at the desired elevation as shown in FIG. 3 of the drawings. The user the positions the walls 20, 30 above and then upon the support members 12. The walls 20, 30 are braced with conventional bracing to ensure the proper vertical alignment. Additional walls 20, 30 are added adjacent the initial walls 20, 30 with the end openings 42 of the reservoirs 40 exposed to one another for merging their respective concrete 18. After the desired number of walls 20, 30 have been properly positioned, the user may then add STYROFOAM or other insulation to the inner or outer surfaces of the walls 20, 30 to increate the insulating properties of the walls 20, 30. The user then pours liquid concrete or other appropriate mixture into the walls 20, 30 which falls downwardly between the walls 20, 30 to the respective reservoir 40. Once the reservoir 40 is completely filled and expanded outwardly, the concrete 18 then begins to fill the space between the walls

20, 30. Once the void between the walls 20, 30 is filled, the user then allows the concrete 18 to harden thereby forming the concrete foundation of the building. The bracing is removed from the walls 20, 30 and the remainder of the foundation is allowed to be created.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A concrete footing and wall system, comprising:

a first preformed wall;

a second preformed wall distally spaced and attached to said first preformed wall forming a void between said walls for receiving liquid concrete;

a reservoir attached to a lower portion of said first preformed wall and said second preformed wall for receiving liquid concrete; and a plurality of support members positioned beneath said reservoir and said walls.

2. The concrete footing and wall system of claim 1, wherein said reservoir is comprised of a flexible material.

3. The concrete footing and wall system of claim 2, wherein said reservoir is comprised of a plastic material.

4. The concrete footing and wall system of claim 2, wherein said reservoir is comprised of a textile material.

5. The concrete footing and wall system of claim 1, wherein said reservoir extends along an entire length of said walls.

6. The concrete footing and wall system of claim 1, wherein said reservoir extends past opposing end portions of said walls.

7. The concrete footing and wall system of claim 1, wherein said reservoir includes a middle portion and a pair of end openings.

8. The concrete footing and wall system of claim 7, wherein said reservoir has a width greater than a distance between the exterior surfaces of said walls.

9. The concrete footing and wall system of claim 1, wherein said first preformed wall is similar in shape and size to said second preformed wall.

10. The concrete footing and wall system of claim 1, including a plurality of cross members extending between said walls.

11. The concrete footing and wall system of claim 1, including a plurality of support poles extending from a lower edge of said walls.

12. The concrete footing and wall system of claim 1, wherein said plurality of support members are positioned on opposing sides of said walls and including a tapered shaft supported upon said support members beneath said walls.

13. The concrete footing and wall system of claim 1, wherein said reservoir is formed within said walls.

14. A method of forming a concrete foundation, comprising the steps of:

(a) providing a pair of preformed walls attached to one another with a void between thereof, and a reservoir having a flexible structure attached to a lower portion of said pair of preformed walls;

(b) positioning a plurality of support members within a footing trench;

(c) positioning said pair of preformed walls upon said plurality of support member;

(d) filling said reservoir and said void within said pair of preformed walls with liquid concrete; and (e) allowing said liquid concrete to harden.

15. A method of forming a concrete foundation, comprising the steps of:

(a) providing a pair of preformed walls attached to one another with a void between thereof, a reservoir having a flexible structure attached to a lower portion of said pair of preformed walls, and a plurality of support poles extending from a lower edge of said pair of preformed walls;

(b) positioning said pair of preformed walls within a footing trench with the lower ends of said plurality of support poles engaging an inner surface of said reservoir for supporting said pair of preformed walls;

(c) filling said reservoir and said void within said pair of preformed walls with liquid concrete; and (d) allowing said liquid concrete to harden.

* * * * *